United States Patent [19]

Gardner

[11] 4,138,053

[45] Feb. 6, 1979

[54] BULK CONTAINER WITH HANDLING FLANGE

[75] Inventor: Jeffrey M. Gardner, Wheaton, Ill.

[73] Assignee: Container Corporation of America, Chicago, Ill.

[21] Appl. No.: 875,452

[22] Filed: Feb. 6, 1978

[51] Int. Cl.[2] ..... B65D 5/72; B65D 13/04

[52] U.S. Cl. ..... 229/23 R; 229/17 B; 229/52 B

[58] Field of Search ..... 229/23 R, 17 B, 52 B

[56] References Cited

U.S. PATENT DOCUMENTS

| | | | |
|---|---|---|---|
| 2,386,546 | 10/1944 | Ely et al. | 229/17 B X |
| 3,099,379 | 7/1963 | St Ease | 229/23 R |
| 3,236,437 | 2/1966 | Johnson | 229/23 R X |
| 3,357,628 | 12/1967 | Fish | 229/23 R |
| 3,744,701 | 7/1973 | Taylor | 229/23 R |
| 4,037,775 | 7/1977 | Bamburg et al. | 229/23 R X |

*Primary Examiner*—Davis T. Moorhead

*Attorney, Agent, or Firm*—Carpenter & Ostis

[57] ABSTRACT

A paperboard, bulk bin type container having an external bottom flange for use with push-pull handling equipment.

1 Claim, 5 Drawing Figures

BULK CONTAINER WITH HANDLING FLANGE

SUMMARY OF THE INVENTION

This invention relates to containers, and more particularly to the so called bulk-bin type of container, which is formed of paperboard and which is provided with means for handling by material handling equipment.

It is an object of the invention to provide a bulk-bin type container having an external flange for use with push-pull type of material handling equipment.

A more specific object of the invention is the provision of a two-piece bulk-bin container having at least one external flange projecting from the bottom of the container for use with push-pull material handling equipment.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 2:
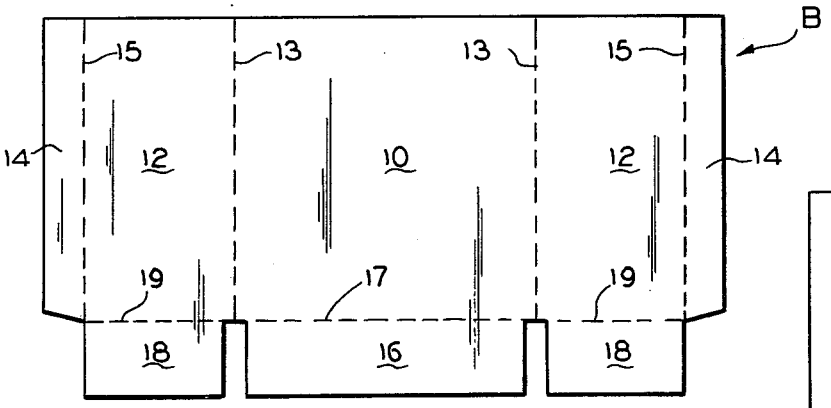
FIG. 2 is a plan view of a blank of foldable sheet material from which one portion of the container illustrated in FIG. 1 may be formed.
Figure 3:
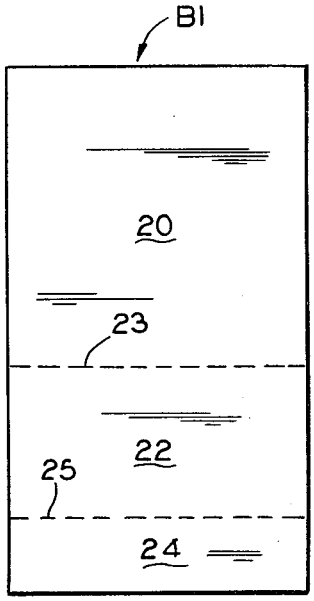
FIG. 3 is a plan view of a blank of foldable sheet material from which another portion of the container illustrated in FIG. 1 may be formed.
Figure 1:
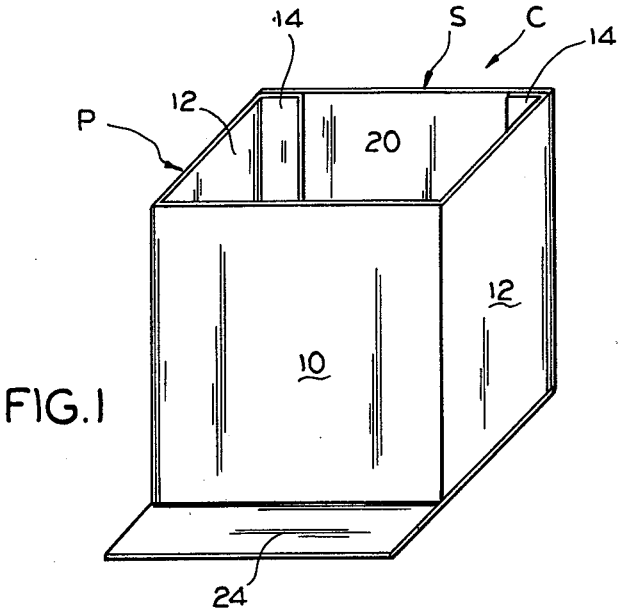
FIG. 1 is a fragmentary perspective view of a bulk-bin type container embodying features of the invention.

Referring now to the drawings for a better understanding of the invention, and particularly to FIGS. 1 through 3, it will be seen that a novel bulk-bin container indicated generally at C and illustrated in FIG. 1 may be formed from a pair of blanks B and B1 of foldable sheet material, such as paperboard, as illustrated in FIGS. 2 and 3, respectively.

Container C is preferably a two piece structure formed from blanks B and B1 which are assembled to provide a tubular structure having a bottom wall and flange projecting therefrom in a manner hereinafter described. The primary section P of container C is formed from the blank B illustrated in FIG. 2. It includes a side wall 10 having a pair of end walls 12 foldably joined to opposed side edges thereof along parallel fold lines 13. A pair of attaching panels or flaps 14 are foldably joined along fold lines 15 to other side edges of respective end walls 12.

A bottom closure panel 16 is foldably joined to the lower edge of side panel 10 along a fold line 17, and a pair of bottom closure panels 18 are foldably joined to the lower edges of end panels 12 along fold lines 19.

As best seen in FIG. 3, panels 10 and 12 form three of the sides of the container; the fourth side of the container is formed from side wall panel 20 of secondary section S which is formed from blank B1 illustrated in FIG. 3. Secondary section S also includes an outer bottom panel 22 which is foldably joined at one side edge along fold line 23 to the lower edge of side wall panel 20. Outer bottom panel 22 is of the same dimensions as the cross sectional area of the container so as to completely cover the bottom of the container. Side wall panel 20 of the secondary section S is secured at its side edges to attaching flanges 14 in any desired manner such as by gluing or stitching. Also, outer bottom panel 22 is rigidly secured in any desired manner such as by gluing or stitching to the undersides of inner bottom wall panels 16 and 18.

Formed integrally with outer bottom panel 22 is a gripping flange or lip 24 which is foldably joined along fold line 25 to the edge of outer bottom panel 22. Flange 24 is disposed to project outwardly from outer bottom panel 22 beyond side wall 10 to provide a means of gripping and moving the container with push-pull type of material handling equipment.

Figure 5:
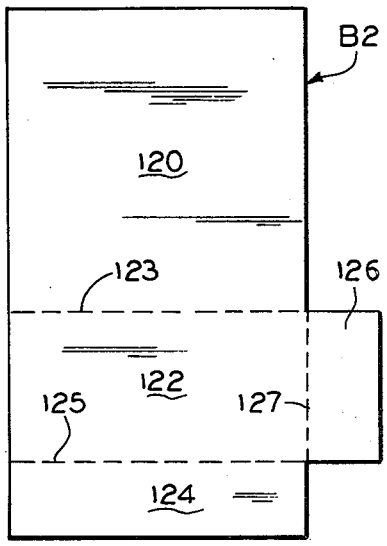
FIGS. 4 and 5 are views similar to those of FIGS. 1 and 3, respectively, but illustrating a modified form of the invention.
Figure 4:
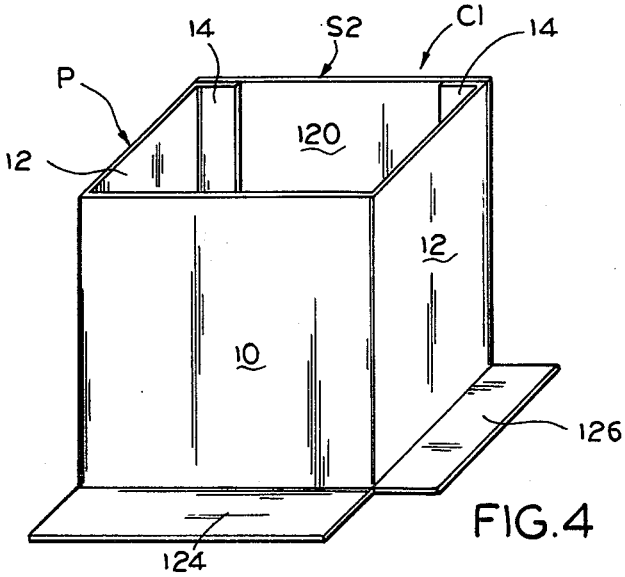

Turning now to FIGS. 4 and 5, it will be seen that a slightly modified form of the invention is illustrated. The structure of this embodiment is similar to that of the previous embodiment and similar portions of the structure have been identified by corresponding numerals.

The primary difference in this embodiment is the addition of another gripping flange or lip 126 which is foldably joined along fold line 127 to another edge of outer bottom panel 122. Flange 126 is disposed at right angles to flange 124 and also projects outwardly beyond related end wall 12 of the container. With this embodiment the container may be grasped by handling equipment from either the side or the end of the container.

Thus, it will be understood that the invention provides a novel bulk bin type container of relatively simple design and construction which is provided with one or more external gripping flanges projecting from the lower portion thereof to facilitate movement of the container by conventional push-pull type material handling equipment.

I claim:

1. A bulk bin type container formed from a pair of paperboard blanks and having an integral, external flange, said container comprising:

(a) a body including a plurality of vertical side walls foldably interconnected at the corners to form a tubular structure;

(b) closure means for the lower end of said tubular structure, including:

(i) an outer closure panel integral with and hinged to a lower edge of one of said side walls;

(ii) inner closure panels foldably joined to lower edges of other of said side walls and folded inwardly and normal thereto and secured to said outer closure panel in overlying relation therewith;

(c) an external gripping flange integral with and hinged to said outer closure panel and projecting outwardly from said tubular structure beyond at least one of said other side walls;

(d) said one side wall, said outer closure panel and said gripping flange being formed from one blank while said other side walls and said inner closure panels are formed from another blank of paperboard.

* * * * *